United States Patent [19]

Yianilos et al.

[11] Patent Number: 4,578,673

[45] Date of Patent: Mar. 25, 1986

[54] VIDEO COLOR GENERATOR CIRCUIT FOR COMPUTER

[75] Inventors: Peter N. Yianilos, Fort Lauderdale, Fla.; Michael L. Wajda, Philadelphia, Pa.

[73] Assignee: Franklin Computer Corporation, Cherry Hill, N.J.

[21] Appl. No.: 512,284

[22] Filed: Jul. 8, 1983

[51] Int. Cl.[4] ..... G09G 1/28

[52] U.S. Cl. ..... 340/703; 340/701; 358/27; 358/903

[58] Field of Search ..... 340/701, 703, 704, 793; 358/23, 25, 27, 903

[56] References Cited

U.S. PATENT DOCUMENTS

| | | | |
|---|---|---|---|
| 4,149,184 | 4/1979 | Giddings et al. | 340/703 |
| 4,183,046 | 1/1980 | Dalke et al. | 340/703 |
| 4,278,972 | 7/1981 | Wozniak | 340/703 |
| 4,360,804 | 11/1982 | Ohura | 340/703 |
| 4,442,428 | 4/1984 | Dean et al. | 340/703 |
| 4,466,015 | 8/1984 | Wargo et al. | 358/27 |
| 4,510,521 | 4/1985 | Ruprecht et al. | 358/27 |

*Primary Examiner*—Gerald L. Brigance

*Attorney, Agent, or Firm*—Caesar, Rivise, Bernstein & Cohen, Ltd.

[57] ABSTRACT

A color video generator for use with a digital computer and a color video display. The computer produces digital data signals, each of which is composed of plural bits which represent a color to be produced. The color video generator produces a color in a portion of the display in response to receipt of an associated one of the first data signals. The color is preselectable. The video generation means operates on a color subcarrier signal composed of three primary color signals and comprises a data code translator having an addressable memory and a video phase modulator having an addressable memory. The translator is responsive to said first data signals for providing second, plural bit digital signals to the phase modulator. The phase modulator operates in synchronism with a phase demodulator in the display and is responsive to receipt of respective ones of the second digital signals. The video generator provides respective output signals during successive portions of one cycle of the color subcarrier signal. Each of the output signals is representative of one of at least three predetermined different amounts of the primary color signals present in that portion of the cycle of the color subcarrier signal as preestablished by the contents of its addressable memory. The output signals are arranged for combination with video synchronization signals and a color burst signal to produce a conventional composite video signal.

5 Claims, 7 Drawing Figures

VIDEO COLOR GENERATOR CIRCUIT FOR COMPUTER

BACKGROUND OF THE INVENTION

This invention relates generally to computers and more particularly to circuitry for computers for producing color video displays.

Various microcomputers are commercially available to home or business applications and include circuitry for producing a color video display on either a color monitor or a standard color television receiver. For example, color video generation circuitry is included in the Apple II® computers sold by Apple Computer Company, Inc. of Cupertino, Calif. The color video producing circuitry used in such computers is shown and claimed in U.S. Pat. No. 4,278,972. That circuitry basically utilizes a shift register combination to sequentially sample individual bits making up an eight bit data code representing a color provided by the computer's random access memory (RAM). The data code representing the color is introduced broadside into two, four-bit shift registers which are each clocked at a frequency of 14.31818 MHz. Each register sequentially shifts the input nibble (four bits) through its stages, with the output of the last stage being coupled back to the input of the first stage. Accordingly, the output of the shift register consists of plural bits representing the data code for the color and appearing at a frequency of 3.579545 MHz (the NTSC standard color subcarrier reference frequency). The digital output signal of the shift register is sequentially sampled, with each bit being used to either turn the video on or off in synchronism with the color reference signal of the receiver. Thus, for each high or "one" bit, the video generator produces an output signal to the receiver's phase demodulator. Conversely, for each low or "zero" bit, no output signal is produced.

The sequential sampling of the data code shifted through the recirculating shift registers has the effect of inherently producing different colors for different data codes. In this regard, as the bits are recirculated a nibble at a time, each cycle of the subcarrier color reference signal is divided into four sectors or quadrants, with successive bits of the nibble representing successive quadrants of the color cycle. Thus, for each bit of the nibble which is high a signal representative of the associated quadrant portion of one cycle of the color subcarrier reference signal is passed to the phase demodulator of the receiver. The demodulator operates in synchronism with the video generator so that the signal produced by the phase demodulator constitutes the portion of the primary color signals (red, blue and green) making up the subcarrier signal in that quadrant, i.e., the appropriate 90° portion of one cycle of the color subcarrier reference signal. If any of the bits in this nibble is low durinng that quadrant of the color subcarrier reference signal, no video is produced.

As will be appreciated, the portions of the primary color signals in the first quadrant of the standard color subcarrier reference signal are 60° of the red signal component and 30° of the blue signal component. The second quadrant (or the next 90° portion of the color subcarrier signal) represents 90° of only the blue signal component. The next 90° of the color subcarrier (that is the third quadrant) represents 90° of only the green signal component, while the last 90° of the color subcarrier signal (that is the fourth quadrant) represents 30° of the green signal component and the remaining 60° of the red signal component.

The output of the receiver's phase demodulator thus constitutes a signal representative of those portions of the primary color signals present during the four quadrants making up one color cycle and thereby produces a unique color.

Owing to the shift register arrangement as described above, each data code produces an inherently predetermined color and that color alone. However, some color codes (nibbles) do not produce unique colors. For example, the binary color code of 1010 (representing the decimal number 10) and the binary color code 0101 (representing the decimal number 5) both produce the same shade of gray in the Apple II® computer.

As will be appreciated from the foregoing, while the video generator disclosed in U.S. Pat. No. 4,278,972 provides a simple means for the production of up to 16 colors from corresponding digital data codes, such a generator leaves much to be desired from the standpoint of functionality, effectiveness and compatibility with other computers.

OBJECTS OF THE INVENTION

Accordingly, it is the general object of the instant invention to provide video generation means which overcome the disadvantages of the prior art.

It is a further object of the instant invention to provide color video generator means which is simple in construction and which can be used to produce a plurality of predetermined, but arbitrary colors.

It is a further object of the instant invention to provide color video generator means which can be utilized with various digital computers to generate at least one palette of different colors.

It is a further objection of the instant invention to provide a color generation circuitry which is simple in construction and which is capable of producing a larger multitude of colors.

SUMMARY OF THE INVENTION

These and other objects of the instant invention are achieved by providing color video generation means for use with a digital computer and a color video display. The color video display includes a receiver having a phase demodulator operating at a color subcarrier frequency. The computer produces first digital data signals, each of which is composed of plural bits and represents an associated color. The color video generation means produces a color in a poriton of the display in response to receipt of one of the first data signals, with the color being preselectable. The color video generation means operates on a color subcarrier signal composed of three primary color signals. The color video generation means comprises translator means and video phase modulator means. At least one of the translator means and the phase modulator means comprises addressable memory means. The translator means is responsive to the first data signals for providing second, plural bit digital signals to the phase modulator means. The phase modulator means operates in synchronism with the demodulator of the receiver and is operative in response to receipt of respective ones of the second digital signals for providing respective output signals during successive portions of one cycle of the color subcarrier frequency. Each of the output signals is representative of one of at least three predetermined different amounts of the primary color signals present in that portion of the cycle of the color subcarrier signal as established by the contents of the addressable memory levels. The output signals are arranged for combination with video synchronization signals and a color burst signal to provide a composite video signal suitable for use by the phase demodulator of the receiver.

Other objects and many of the attendant advantages of this invention will be readily appreciated as the same becomes better understood by reference to the following detailed description when considered in connection with the accompanying drawings wherein:

DETAILED DESCRIPTION OF THE PREFERRED EMBODIMENT

Figure 1A:
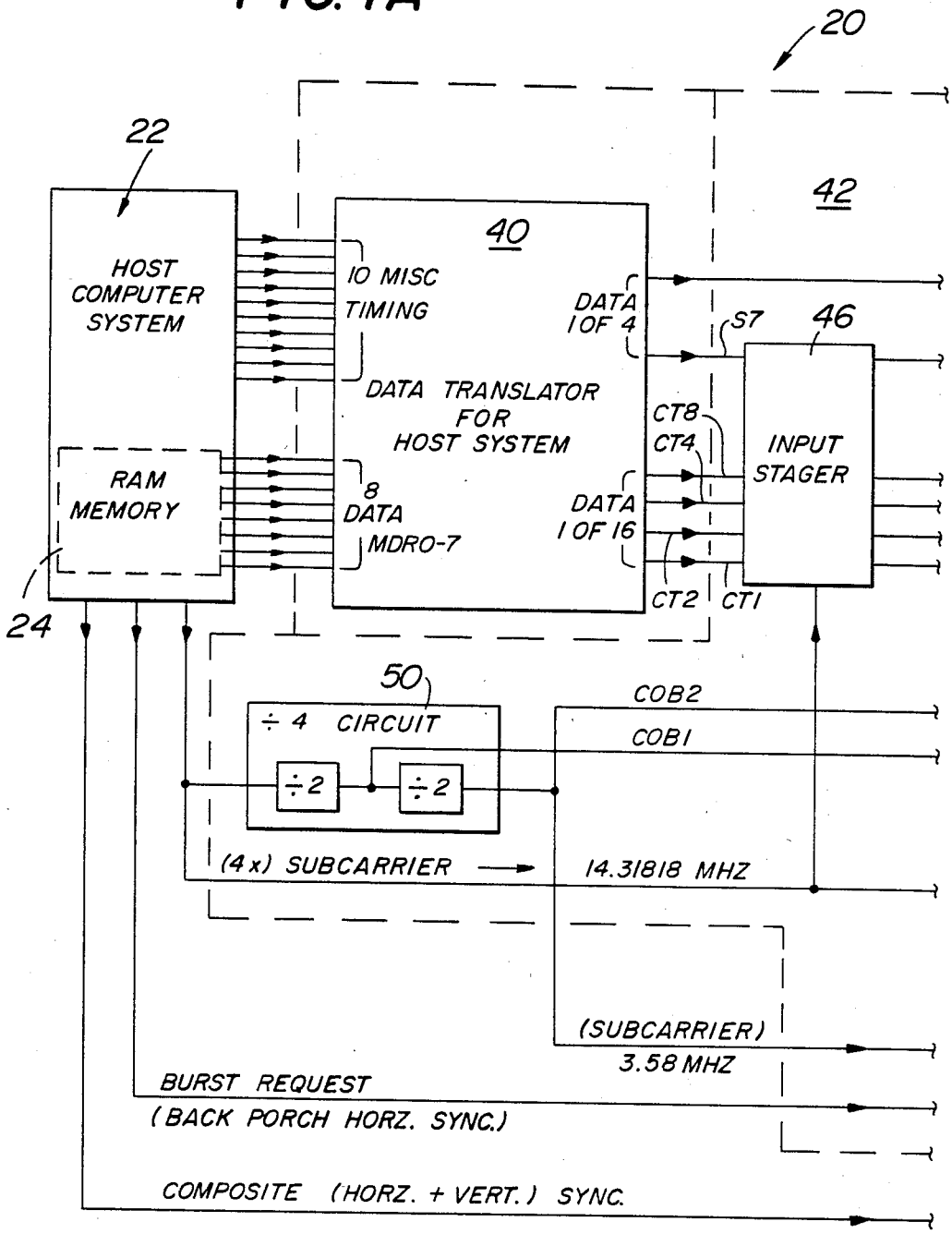
FIG. 1(A) is one portion of a block diagram showing the video generator of the subject invention as connected to a conventional computer and to either a conventional color video monitor or a conventional color television receiver.

Referring now to various figures of the drawing wherein like reference characters refer to like parts, there is shown generally at 20 in FIGS. 1(A) and (B) color generation circuitry constructed in accordance with the instant invention.

Figure 1B:
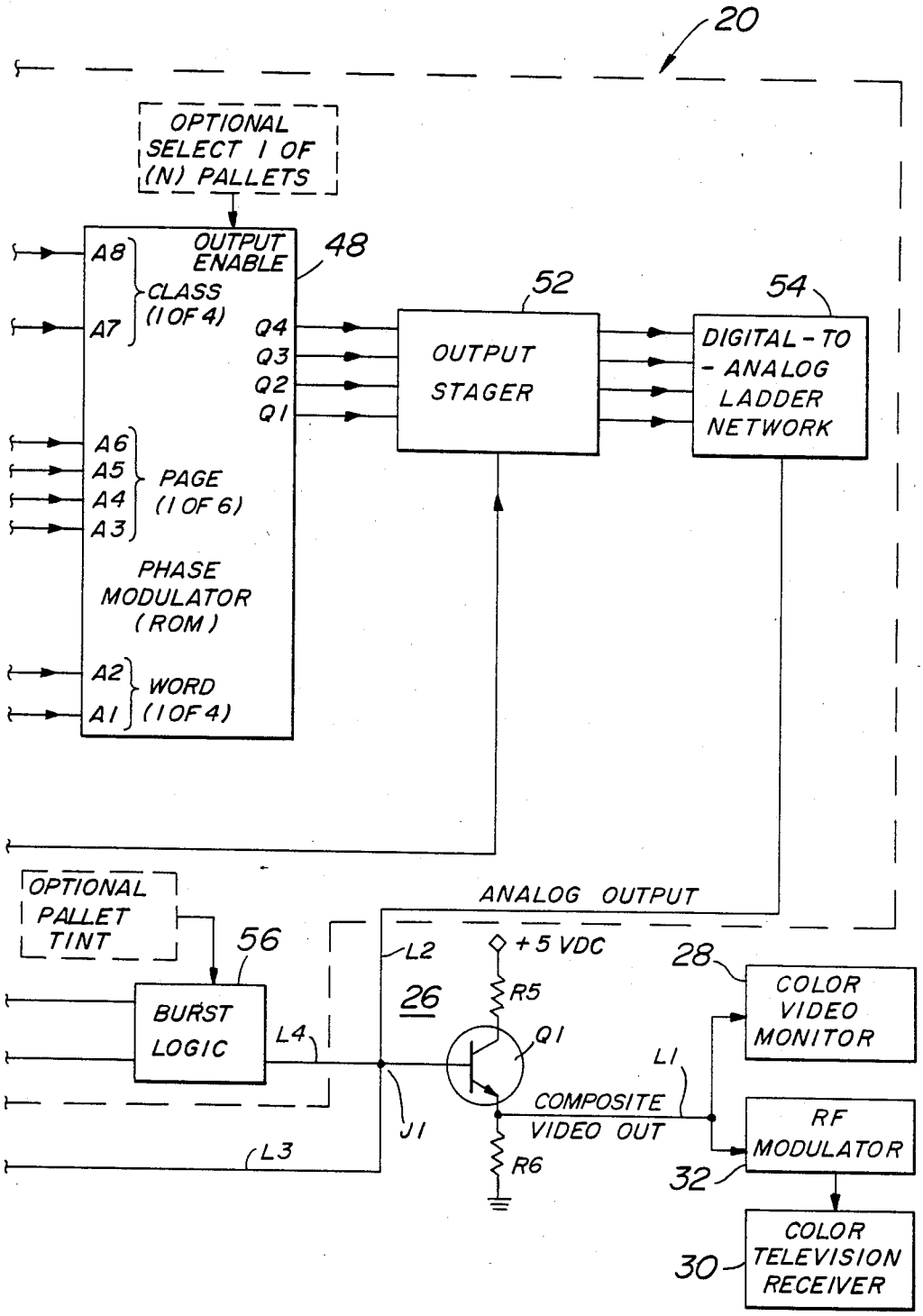
FIG. 1(B) is the other portion of the block diagram of FIG. 1(A)

The color generation circuitry 20 is utilized in connection with a conventional host computer system 22 including a random access memory (RAM) 24 which provides various digital signals representing respective colors to be generated by the computer. To that end, the host computer system 22 includes a composite video output stage 26 (FIG. 1(B)) at which a conventional composite video output signal is produced in accordance with this invention. The composite video signal is provided on line L1 for direct connection to a conventional color video monitor 28 to produce color graphics thereon or to a conventional color television receiver 30, via a conventional RF modulator 32.

The video generator circuitry of the subject invention basically comprises a host system data translator 40 and video phase modulator and associated means 42. The video phase modulator and its associated means basically comprises an input stager 46, a phase modulator 48, timing control means 50, an output stager 52, a digital/analog ladder network 54 and burst logic producing means 56.

The host system data translator 40 is arranged to receive an eight bit "color" code from the random access memory 24 of the host computer system via the computer's memory data bus. The eight bit code represents a color to be generated by the generator 20. The details of the host system data translator 40 will be described later. Suffice to state now that the translator serves to provide digital signals in proper sequence to the phase modulator to effect proper color or character production, irrespective of the mode of operation of the computer, e.g., whether in a high resolution mode, a low resolution mode or a text mode. The data translator includes various circuits (to be described later) for accomplishing that end and, in addition, includes ten input lines from the host computer system, which lines provide ten miscellaneous timing signals for the data translator.

NTSC standards require that chromatic information be transmitted by means of a color subcarrier signal modulated in amplitude and phase with respect to the reference subcarrier of the same frequency. The color subcarrier is to be transmitted simultaneously with the video signal and during only the video portion of the composite signal. Synchronization signals to transmit information concerning the reference subcarrier is transmitted only during the synchronization and blanking intervals of the composite video signal.

As will be appreciated by those skilled in the art, the standard NTSC color subcarrier signal of 3.57945 MHz is composed of the three primary color signals spaced at 120° angles from each other and, in accordance with the standard "CBS Field Sequential System", are in order of red, blue and green. The relationship of the color component signals of the color subcarrier is shown graphically in polar coordinates FIG. 4(A). Thus, as can be seen, the red component signal is of 120° duration and begins at its minimum or zero value at 300° going to its maximum value at 0° and then back to its minimum value at 60°. The blue component signal starts at its minimum or zero value at 60° going to its maximum value at 120° and then back to its minimum value at 180°. The green component signal starts at its minimum or zero value at 180° going to its maximum at 240° and then to its minimum at 300°.

The phase modulator 48 and associated means of generator 20 are arranged upon receipt of signals from the data translator to provide an analog output signal on line L2. The analog output signal represents the proportions of the three primary color signals (red, blue and green) to produce the desired color. Hence, the analog signal appearing on line L2 represents the combined chrominance and luminance signal of a conventional NTSC Dot Sequential Color Transmitter System. The analog signal appearing on line L2 is added vectorally at an analog summing junction shown schematically at J1 in FIG. 1(B) to a signal appearing on line L3 and to a signal appearing on line L4. The signal appearing on line L3 is provided by the output of the host computer system and constitutes the conventional NTSC composite horizontal and vertical synchronization signals. The signal appearing on line L4 is produced by the burst logic circuit 56 and constitutes a conventional 3.58 MHz color reference (red) burst signal. The resultant signal appearing at junction J1 is amplified by an emitter-follower transistor Q1 to provide a conventional composite video signal on line L1 for use by either a color monitor 28 or a color receiver 30. The demodulator circuitry in the receiver (not shown) operates in synchronism with the phase modulator of the color generation means 20 to decode the three primary color signal components (red, blue and green) by modulating the color subcarrier.

As will be appreciated from the discussion to follow, the video phase modulator 48 of the subject invention is arranged to modulate each of the three primary color signals making up the color subcarrier to at least three amplitude levels. In the disclosed embodiment the signals are modulated to five levels ranging from 0% to 100%, in 25% increments. To accomplish that end, the phase modulator 48 breaks the color cycle (that is, one complete cycle of the color subcarrier signal) to the four quadrants as shown in FIG. 4(B). This is accomplished by dividing the master clock signal to produce two clock signals, one being twice the color subcarrier frequency and the other being the subcarrier frequency. In accordance with the preferred embodiment of the invention, the phase modulator 48 comprises a ROM having various output codes burned into its various address locations. A four bit input signal representing one of sixteen blocks of four words to be accessed by the circuitry is provided at "Page" input address lines (to be described later) of the phase modulator ROM 48. The phase modulator ROM is arranged to sample all of the bits provided to the "Page" input address lines at one time and to recognize the contents thereof as data for the color to be generated (when in a graphics mode) or for a character to be generated (when in the text mode). The recognition of whether the data represents text or graphics, and if the latter, the type of resolution desired for the graphics is accomplished by a pair of side bits provided to the "Class" input address lines (to be described later) of the phase modulator ROM. The two clock signals are provided to the "Word" input address lines (to be described later). In particular, the color subcarrier frequency clock signal is provided to the next to the lowest order address line of the ROM 48 while the clock signal of twice the subcarrier frequency is provided to the lowest order address line. By providing these two signals to the two lowest order address lines of the ROM, each full cycle of the color subcarrier (which cycle is referred to as a color clock) is broken down into four 90° sectors or quadrants.

The ROM 48 includes in its various address locations output codes representative of the desired "intensity level" of the analog signal to be produced by the video generator. By "intensity level" it is meant the amount of the primary color signal(s) present in each section (e.g., quadrant) of one color cycle to produce the desired signal. To that end, in the embodiment shown herein, for each address defined by a quadrant or "Word" and a "Page" input, a four bit output code consisting of either all zeros, a one and three zeros, two ones and two zeros, three ones and one zero, or all ones, is produced. The ROM code of all zeros is conveniently used to represent a 0% intensity level, the code of three zeros and a one represents a 25% intensity level, the code of two zeros and two ones represents a 50% intensity, the code of one zero and three ones represents a 75% intensity level, and the code of all ones represents a 100% intensity level.

As will be appreciated by those skilled in the art, other codes can be used to represent the five various percentages. Thus, the position of the ones and zeros in the code is irrelevant.

Since the lowest order address line of ROM 48 receives the 7.16 (7+) MHz clock signal and the next higher order address line receives the 3.58 MHz clock signal, the phase modulator ROM is sequenced by the "Word" inputs at a clock frequency of the color subcarrier. Thus, the output of the ROM 48 for a given signal provided to its "Page" input when the two "Word" address lines are both low is equal to the code content of the ROM at that address and represents that portion of the primary colors making up the subcarrier located within the first quadrant (first 90° of the color subcarrier frequency). When the input "Word" address to the ROM is high at the lowest address line and a low at the next higher order address line (representing the second quadrant of the color subcarrier) the "Page" input defines another output code representing from 0 to 100% of the primary color signals in the second quadrant. So, too, when the input "Word" address to the ROM is a low at the lowest order address line and a high at the next higher order address line (thus representing the third quadrant) the "page" input defines another output code representing from 0% to 100% of the primary color signals making up the third quadrant. Finally, when the input "Word" address to the ROM at the two lowest address lines is high on both lines (thus representing the final or fourth quadrant of the color subcarrier) the "Page" input defines another output code representing from 0 to 100% of the primary color signals making up the fourth quadrant. Thus, for each given input signal (a nibble) to the "Page" inputs of the ROM, the ROM is cycled through four quadrants of the color subcarrier to provide an output representing respective percentage portions (amounts) of the primary color signals red, blue and green making up the successive quadrants of one cycle of the color subcarrier.

Figure 4A:
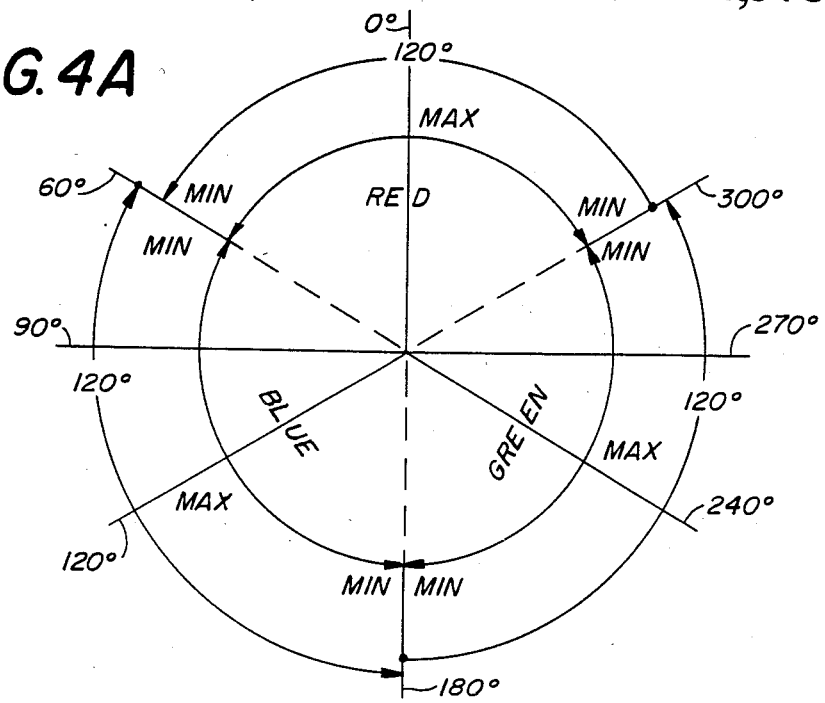
FIG. 4(A) is a graphical representation of one cycle of a standard color subcarrier reference signal showing its three component primary color signals.
Figure 4B:
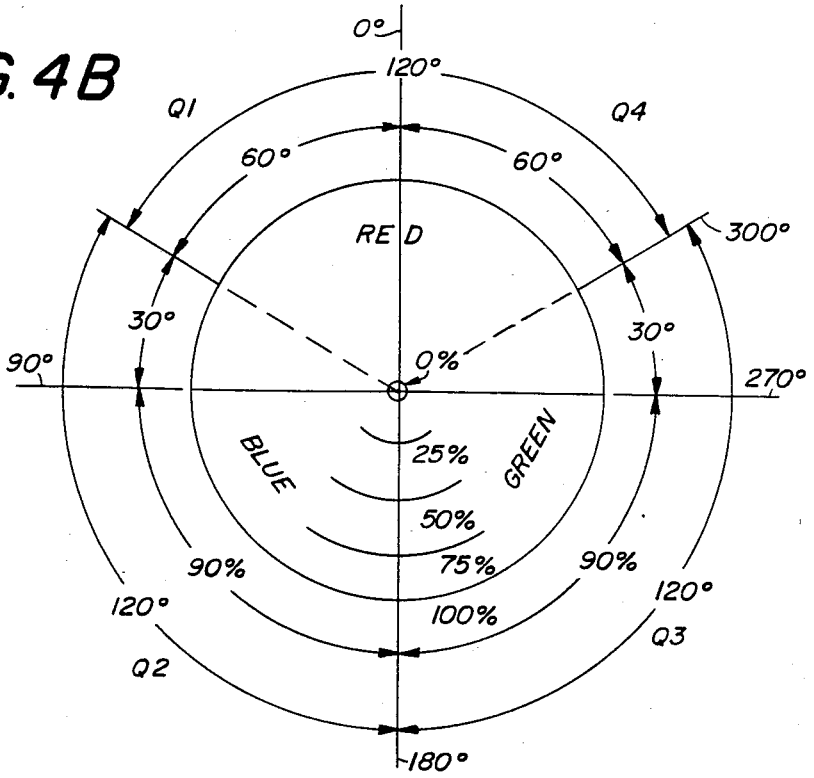
FIG. 4(B) is a diagram, like that shown in FIG. 4(A) of the universe of outputs of the phase modulator portion of the color generation means of the instant invention.

In FIG. 4(B), there is shown graphically in polar coordinates like that of FIG. 4(A) one color cycle of the color subcarrier and showing the five possible degress of amplitude modulation produced by the phase modulator ROM shown herein. As should thus be appreciated, during the first 90° of the color subcarrier reference signal, the phase modulator ROM can provide an output signal of either 0%, 25%, 50%, 75% or 100% of 60° of the red component color signal and 30° of the blue component color signal (those portions located within the first quadrant Q1) of the color subcarrier, depending upon the code content in the phase modulator ROM. During the second quadrant Q2 of the color subcarrier, the ROM can produce an output signal equal to 0%, 25%, 50%, 75% or 100% of the 90° of the blue component signal located within that quadrant. During the third quadrant Q3 of the color subcarrier, the ROM can produce an output signal equal to 0%, 25%, 50%, 75% or 100% of the 90° of the green signal within the third quadrant. Finally, during the last quadrant Q4, the ROM can produce an output signal equal to 0%, 25%, 50%, 75% or 100% of the 30° of green signal and 60° of red signal within the fourth quadrant.

The output signals from the ROM produced during each quadrant are fed to an output stager or latch (to be described later) to ensure that all the output signals are provided coincident in time to the digital/analog ladder network 54, to be described in detail later. Suffice for now to state that the network 54 includes a resistor ladder which produces analog signals representing the percentage of colors in the successive portions of the color cycle. The sum total of those percentage portions represents the total amount of red, blue and green color signals in one cycle of the color subcarrier, thereby defining a unique color. The analog signal defining a unique color is provided via line L2 to the summing junction J1 for combination with the other signals (e.g., the color burst from the burst logic 56) to complete the composite video output signal.

As will be appreciated by those skilled in the art, since the video modulator modulates the color subcarrier reference signal (and hence its three signal color components red, blue and green) into at least three amplitude levels (in fact, five) the phase modulator is capable of producing more colors than the prior art system disclosed in U.S. Pat. No. 4,278,972 (Wozniak). In this regard, in the system of that patent, the use of shift registers to turn the video generator on or off during each quadrant of the color subcarrier signal permits the generation of only two amplitude levels, namely 0% and 100% of the color subcarrier. In contradistinction, the color video generation means of the subject invention modulates the color signals to at least three, and preferably, five amplitude levels. Thus, with five amplitude levels, a four bit digital data code (nibble) can produce 16 unique colors out of a gamut of 625 colors, whereas in the prior art the four bit digital signal can only produce its colors out of a gamut of 16 colors.

It must be pointed out at this juncture that the data code presented to the phase modulator ROM (that is the page address input code) is arbitrary so long as the phase modulator ROM has stored in its address locations the necessary code to result in the production of the desired color as the ROM is cycled through the sectors making up the color cycle. Moreover, by breaking up the color cycle into more than four sectors (quadrants), more subtle color variations are possible since the various amplitude levels will thus modulate more portions of the color subcarrier cycle. In this regard, by cycling the phase modulator ROM through eight sectors (such as by the use of a third low order address line representing four times the color subcarrier clock frequency), one can produce for a given nibble input code 16 colors out of a possible gamut of 380,625 colors.

As will be described in detail later, and in accordance with the practical embodiment of the subject invention, in order for the color generation circuit of this invention to be compatible with the Apple II® computer and with the software written therefor, the phase modulator ROM also includes address lines to select the type of display mode (class) desired, i.e., high resolution 1 (hires 1), high resolution 2 (hires 2), low resolution (lores) or text.

The data translator 40 is arranged to take the eight bit data code appearing from the memory data bus and, depending upon the class of operation the computer is in, present that data to the phase modulator 48 (via the input stager 46) in an appropriate number of four-bit data packets. The output of the data translator, as noted before, is an arbitrary code, that is it can be any code desired, providing that the phase modulator ROM 48 is arranged to recognize that code to provide the desired output signals to generate the desired modulation. As should thus be appreciated, the data translator 40 can be uniquely configured to provide data codes which are recognized by the phase modulator ROM to emulate the modulation (color) generation ability of any particular computer system.

Figure 2A:
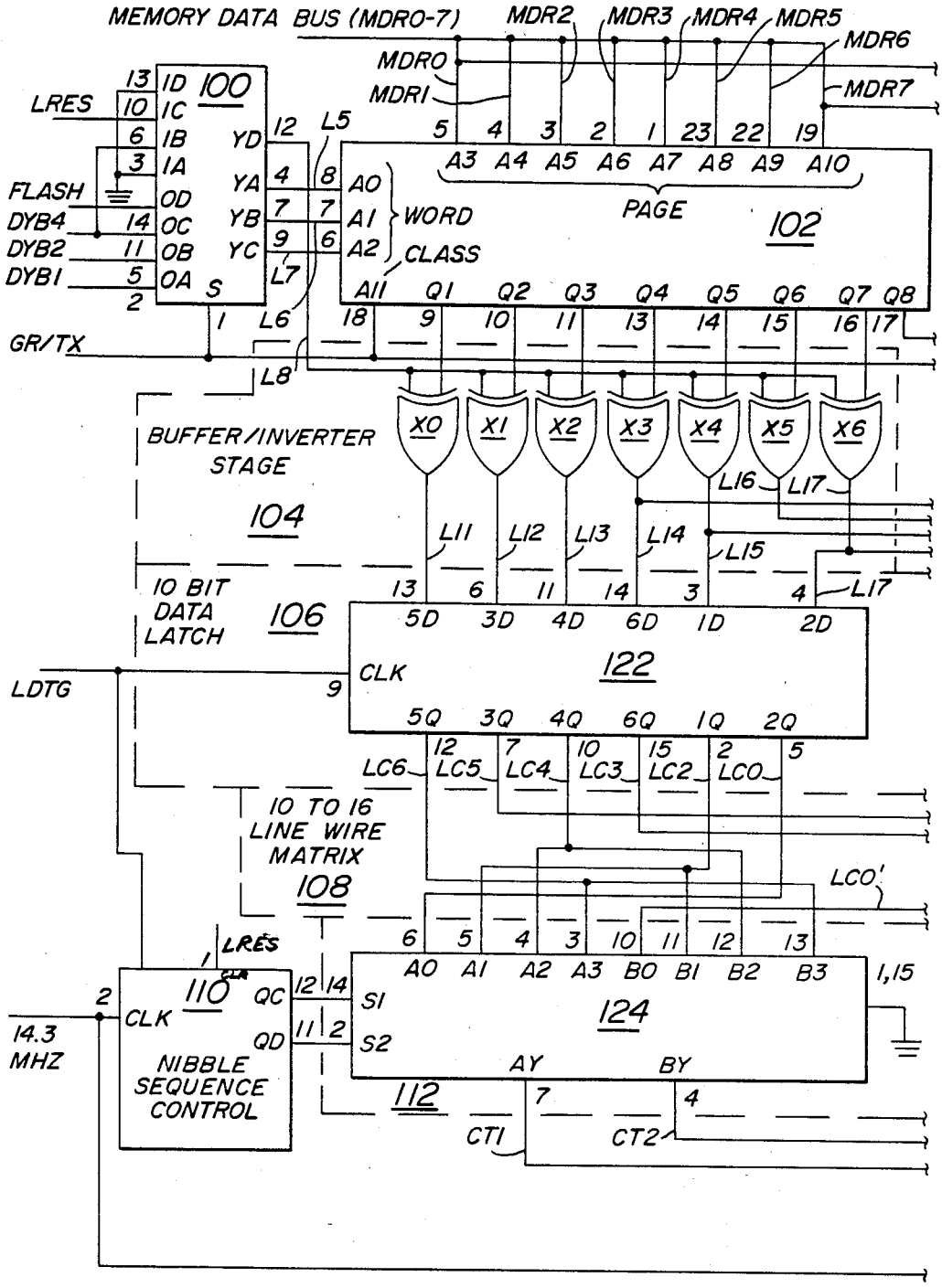
FIG. 2(A) is a schematic diagram of the circuit details of a portion of the color generation means shown in FIG. 1(A)
Figure 2B:
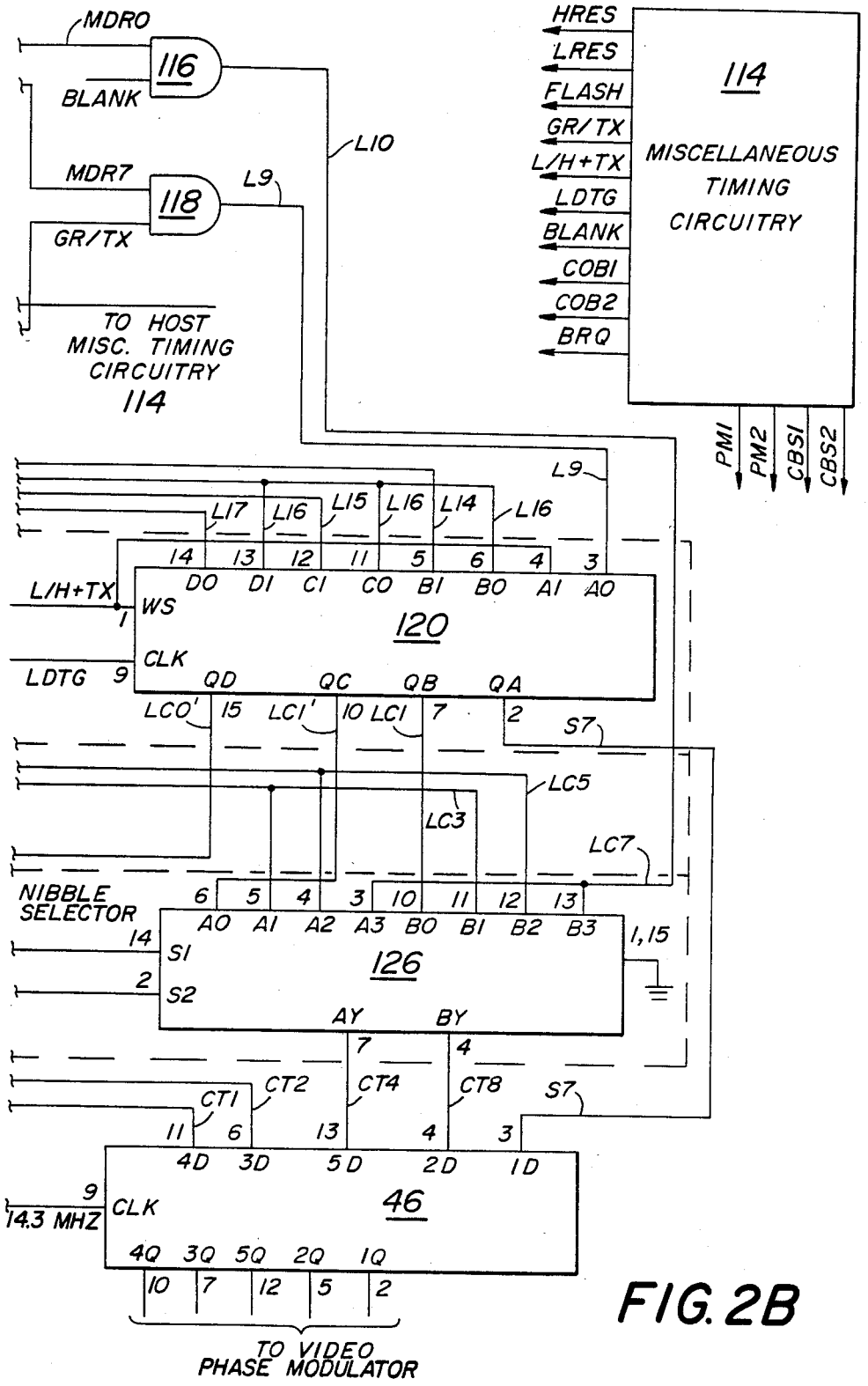
FIG. 2(B) is a schematic diagram of the circuit details of a portion of the color generation means shown in FIG. 1(A)

Referring now to FIGS. 2(A) and 2(B), the details of the data translator 40 for the host system will now be described. Thus, as can be seen, the data translator basically comprises a multiplexer 100, a data encoder PROM 102, a buffer/inverter stage 104, a 10-bit data latch 106, a 10-to-16 line wire matrix 108, a nibble sequence control circuit 110, and a nibble selector 112.

The Apple II® computer and other computers compatible with the software written therefor are arranged to produce 40 character cells per horizontal row on the video display. Thus, for a color subcarrier reference signal of 3.579545 MHz, it takes 3.5 color clocks (cycles of the subcarrier) to produce one character cell. Moreover, Apple® compatible computers have, as noted heretofore, three basic modes of operation, namely a low resolution mode, two high resolution modes, and a text mode. In the low resolution mode, each character cell is defined by a pair of nibbles (four bit digital words) provided from the random access memory by the memory data bus (to be described later). One nibble defines the upper half of the character cell and the other nibble defines the lower half. Thus, with two four bit data codes, the character cell is broken down into two blocks of sixteen possible colors, with each character cell being 14 bits wide ($4\times3.5$). The height of each character cell is eight lines (two blocks of four lines). In the high resolution modes, the data code provided by the memory data bus and representing the color to be displayed is made up of seven bits and an eighth bit is used to select which one of two, four color palettes is to be selected (as will be described later). In the high resolution modes, each color cycle is broken down into two parts with the character cell generated being seven bits wide ($2\times3.5$) by eight lines high.

In order for the color video circuit shown and claimed herein to be compatible with the software written for the Apple® compatible computers, the data translator 40 includes the heretofore identified multiplexer 100, a look ahead gate 116 and an "eighth bit" gate 118.

The multiplexer serves as the "Word" selector control for the translator 40, that is, it is arranged to provide timing and control signals to the encoder PROM 102 to establish the desired mode of operation (e.g., hires, lores, text). In particular, the timing signals are provided by multiplexer 100 via three lines L5, L6 and L7 to the three lowest order address lines (to be described later) of the PROM 102. These signals represent the timing signals necessary to produce the appropriate type and size character cell on the video display as established by the mode selected.

In the interest of brevity, all of the details of the multiplexer 100 and its input signals will not be described herein. Suffice to say that the multiplexer is a quad, data selector/multiplexer type integrated circuit having two pairs of four input lines. One group (i.e., text) is the "zero" inputs 0A, 0B, 0C and 0D and the other group (i.e., graphics) is the "one" inputs 1A, 1B, 1C and 1D. A signal input line DYB1 is connected to pin 2 (the 0A input line). A second signal input line DYB2 is connected to pin 5 (the 0B input line). A third signal input line DYB4 is connected to pins 11 and 6 (the 0C and 1B input lines, respectively). A "Flash" signal input line is connected to pin 14 (the 0C input line). The "Flash" signal is used to produce a flashing cursor or character on the video display. A "lores" signal input line is connected to pin 10 (the 1C input line). Input pins 3 and 13 (the 1A and 1D input lines, respectively) are both grounded. The various input signals carried by the input lines of the multiplexer 100 are provided by appropriate circuits in the host computer, e.g., miscellaneous timing circuits 114 (FIG. 2(B)).

The output of the circuit 100 is provided at YA-YD output pins 4, 7, 9 and 12, respectively. The selection of which of the two groups of input signals are to be provided to the output lines is determined by the signal appearing at selector input pin 1. This pin is connected to a graphics/text signal line GR/TX. The output pins 4, 7 and 9 are connected to heretofore identified lines L5, L6 and L7, respectively. The YD output pin 12 is connected to line L8.

Operation of the multiplexer 100 is as follows: When the computer is in the low resolution mode, the signal on line GR/TX is high, whereupon to generate the upper half of the character cell, the multiplexer provides low signals on lines L5, L6, L7 and L8. For the lower half of the character cell the circuit 100 provides low signals on lines L5, L7 and L8 and high signal on line L6. When the host computer is in the high resolution mode line L7 is high for the entire height of the character cell, while line L6 is low for the first four lines and high for the second four lines. When the computer is in the text mode lines L5, L6 and L7 advance through the sequential binary states of 0–7 (decimal).

The encoding PROM 102 has twelve input address lines, A0–A11, with A0 being the lowest address line and line A11 the highest. The address lines are provided at pins 8, 7, 6, 5, 4, 3, 2, 1, 23, 22, 19 and 18, respectively. The three address lines, A0, A1 and A2, are the lowest order address lines and are denoted hereinafter as the "Word" address lines. It is these address lines which receive the graphics/text mode input signals provided by lines L5–L7, respectively, from circuit 100. The next higher order address lines A3–A10, hereinafter denoted as the "Page" address lines, are connected to the memory data bus from the host computer. The memory data bus includes eight lines MDR0–MDR7. Line MDR0 is connected to ROM address line A3, MDR1 is connected to address line A4 and so forth. The highest order address line A11 is hereinafter denoted at the "Class" address line and is connected to the graphics text line GR/TX.

The PROM 102 is arranged to provide appropriately encoded digital output signals on its eight output lines Q1–Q8 upon receipt of the data code signals provided by the memory data bus for the various modes of operation (as established by the timing signals provided on the "Word" input lines A0–A2 and the digital signal appearing on the "Class" input line A11). The line GR/TX carries a high signal when the computer is operating in the graphics mode and a low (zero) signal when in the text mode.

As can be seen, the output lines Q1–Q7 of the PROM 102 are provided at pins 9, 10, 11, 13, 14, 15 and 16, respectively, with each of said pins being connected to one input line of a respective EXCLUSIVE OR gate in the buffer/inverter stage 104. Thus, pin 9 of ROM 102 is connected to one input of EXCLUSIVE OR gate X0, pin 10 is connected to one input of EXCLUSIVE OR gate X1, pin 11 is connected to one input of EXCLUSIVE OR gate X2, pin 13 is connected to one input of EXCLUSIVE OR gate X3, pin 14 is connected to one input of EXCLUSIVE OR gate X4, pin 15 is connected to one input of EXCLUSIVE OR gate X5, and pin 16 is connected to one input of EXCLUSIVE OR gate X6. The other input to each of the EXCLUSIVE OR gates X0–X6 is connected to line L8, the YD output line of the multiplexer 100. Line L8 serves as the control line for the EXCLUSIVE OR gates to establish whether they act as buffers or inverters. Thus, when in the graphics mode, line L8 is low, which causes each of the connected OR gates to act as a buffer. This action results in the non-inversion of the binary signals apearing on lines Q1–Q7 of the encoder PROM. In the text mode, the line L8 is high or low so that the EXCLUSIVE OR gates act as either inverters or buffers depending upon the FLASH signal. When the flash signal is high the EXCLUSIVE OR gates act as inverters thereby inverting the signals appearing on lines Q1–Q7 to the respective inputs of the 10-bit data latch so that the character produced is black-on-white. When the flash signal is low, the character produced is white-on-black.

The signals appearing on the memory data bus input lines MDR0–MDR7 are either an ASCII code for the symbol to be generated within the character cell (when in the text mode) or a digital code representing color to be produced at that particular character cell.

As mentioned earlier, in the interest of compatibility the data translator includes the "look-ahead" NAND gate 116 and the "eighth bit" NAND gate 118.

In the high resolution graphics mode of Apple® compatible computers, the eighth bit (MDR7) is utilized to select one of two alternate color sets of the phase modulator. In this regard, the Apple II® computer has two high resolution modes of operation, each mode producing four colors (although two colors in each mode are common, namely black and white). One high resolution mode is produced without the eighth bit and the other with the eighth bit. The NAND gate 118 serves as the means for providing the eighth bit from the memory data bus to the color generation circuitry herein to enable the color generation circuitry to accurately simulate the production of a pallet of colors like that produced by an Apple II® computer. Thus, as can be seen in FIG. 2B, the NAND gate 118 includes two input lines, one being the eighth bit (MDR7 line from the memory data bus) and the other being the graphics/text line GR/TX. The output of NAND gate 118 is connected to one input of the 10-bit data latch 106 (to be described later). Thus, when in the text mode, such that a low signal appears on line GR/TX, NAND gate 118 is disabled, thereby precluding the passage of the eighth bit of the data code to the 10-bit data latch. Conversely, when the system is in the graphics mode, the high signal appearing on line GR/TX enables the eighth bit to be provided to the 10-bit data latch.

The "look-ahead gate" 116 is used to determine the color of the transition points between successive contiguous character cells when in either of the high resolution graphics modes. Inasmuch as the graphics or character cell is seven bits wide, when going from the rightmost picture elements in the character cell (representative of the seventh bit) to the leftmost edge picture elements of the next character cell (representative of the first bit) it is necessary to know if the leftmost bit is high or low to determine the color to carry through. Accordingly, the look-ahead gate is arranged to look ahead to the least significant bit coming from memory in the eight bit data code to determine its state. Thus, during the horizontal blanking interval a low signal appears on the BLANK line from the miscellaneous timing circuit 114, thereby disabling the NAND gate 116. This action prevents miscellaneous data from affecting the righthand edge color of a graphic (character) cell in high resolution graphics. In this regard, as noted earlier, each character cell is made up of three and one-half color clocks (which in high resolution graphics represents seven bits). The look-ahead gate provides means for introducing into the nibble provided to the phase modulator ROM 48 an eighth bit corresponding to the lower order bit of the next character cell coming from memory. This eighth bit is added via the nibble selector circuit 112 (as will be described later) so that there will be no discontinuity in the transition point from the rightmost edge of one character cell to the leftmost edge of the other character cell, which discontinuity would be interpreted by the phase modulator ROM 48 as a different color. The output of the look-ahead gate 116 is provided, via line L10, as one input to the nibble selector.

The 10-bit data latch in combination with the 10-to-16 line wire matrix is arranged to take the seven bits from the buffer/inverter stage 104 and the eighth bit from the NAND gate 118 to upcode them into 16 bits (four nibbles) for use by the nibble selector 112. In particular, the 10-bit data latch takes the input signals and upcodes them into 10 bits. The wire matrix 108 in turn converts the 10 bits into 16 bits.

As can be seen in FIGS. 2(A) and 2(B), the 10-bit data latch 106 consists of the previously identified integrated circuit 120 and another integrated circuit 122. The circuits 120 and 122 are conventional devices. For example, circuit 120 comprises a quad 2-to-1 multiplexers with storage and circuit 122 comprises a hex D-type flip-flops. Thus, the circuits 120 and 122 together form a 10-bit data latch. The function of the data latch is to receive the output signals from the buffer/inverter stage 104 (which signals represent the "Word" on the "Page" in the PROM 102) and from the eighth bit NAND gate 118 and to store those signals during the time that the memory data bus is performing other operations, e.g., DMA (direct memory access), etc. Thus, while the computer microprocessor is getting its data, the data latch stores the signals coming out of the PROM 102 for the duration of the character cell of the display.

The connections between the buffer/inverter stage 104, the NAND gate 118 and the 10-bit data latch 106 are as follows: The output of gate X0 is connected via line L11 to pin 13 (the 5D input) of circuit 122. The output of gate X1 is connected via line L12 to pin 6 (the 3D input) of circuit 122. The output of gate X2 is connected via line L13 to pin 11 (the 4D input) of circuit 122. The output of gate X3 is connected via line L14 to pin 14 (the 6D input) of circuit 122 and to pin 5 (the B1 input) of circuit 120. The output of gate X4 is connected via line L15 to pin 3 (the 1D input) of circuit 122 and to pin 12 (the C1 input) of circuit 120. The output of gate X5 is connected via line L16 to pins 11 and 6 (the C0 and B0 inputs, respectively) of circuit 120. The output of gate X6 is connected via line L17 to pin 4 (the 2D input) of circuit 122 and pin 14 (the D0 input) of circuit 120. Pin 9 is the clock input for each circuit 120 and 122 and is connected to a line LDTG which is in turn connected to the miscellaneous timing circuitry 114. Both circuits 120 and 122 are clocked at a frequency of 1.0227271 MHz via line LDTG, with the data being clocked on the positive going or trailing edge of the clock signal. When clocked, the input signals appearing on inputs 1D to 6D appear at flip-flop outputs 1Q to 6Q (pins 2, 5, 7, 10, 12 and 15, respectively). Those outputs are connected to lines LC2, LC0, LC5, LC4, LC6 and LC3, respectively. The data latch circuit 120 is a device similar to the multiplexer 100 in that signals on its two groups of four input lines are selectively directed to and stored in respective output flip-flops of the circuit, depending on the signal appearing on the circuit's select line (pin 1). The select input pin 1 of circuit 120 is connected to a line L/H+TX provided by the miscellaneous timing circuitry 114. The signal appearing on that line is either a high (i.e., in lores mode) or low (i.e., in text or hires modes). The QA, QB, QC and QD outputs of circuit 120 are provided at pins 2, 7, 10 and 15 connected to lines S7, LC1, LC1′ and LC0′, respectively.

The outputs of the 10-bit data latch 106 serve as the inputs to a 10-to-16 line wire matrix circuit 108. That circuit consists of hard-wired interconnections among the output lines from the 10-bit data latch to produce 16 input lines for the nibble selector circuit 112.

The nibble selector, as noted heretofore, is arranged to selectively produce appropriate binary output signals (nibbles) from the signals appearing on its various input lines under the control of control signals provided by the nibble sequence control circuit 110. The nibble selector basically comprises a pair of integrated circuits 124 and 126. Each circuit is a dual 4-to-1 line data selectors/multiplexers. Thus, each circuit is arranged to enable one of four input signals from one group to pass to one output while enabling one of another four input signals from another group to pass to another output, depending on the signals at the circuit's select lines.

In particular, one group of inputs to multiplexer 124 consists of inputs A0, A1, A2 and A3 (pins 6, 5, 4 and 3, respectively). The other group of four inputs to the multiplexer 124, that is the B0–B3 inputs, are provided by pins 10, 11, 12 and 13, respectively. In a similar manner, multiplexer 126 includes four inputs, namely the A0–A3 (provided at pins 6, 5, 4 and 3, respectively) while its other four inputs, namely B0–B3, are provided by pins 10, 11, 12 and 13, respectively.

The connections between to 10-to-16 line wire matrix and the inputs to the data latch are as follows: Line LC6 from the 10-bit data latch is connected to pins 3 and 13, the A3 and B3 inputs, respectively, of multiplexer 124. Line LC5 is connected to pin 12, the B2 input to multiplexer 126. Line LC4 is connected to pins 4 and 12, the A2 an B2 inputs, respectively, of multiplexer 124. Line LC3 is connected to pins 5 and 11, the A1 and B1 inputs, respectively, of multiplexer 126. Line LC2 is connected to pins 5 and 11, the A1 and B1 inputs, respectively of multiplexer 124. Line LC0 is connected to pin 6, the A0 input of multiplexer 124. Line LC0′ is connected to pin 10, the B0 input, of multiplexer 124. Line LC1′ is connected to pin 6, the A0 input, of multiplexer 126. Line LC1 is connected to pin 10, the B0 input, of the multiplexer 126. Finally, line L10, the output of the NAND gate 116 is connected to LC10 and that line is, in turn, connected to pins 3 and 13, the A3 and B3 inputs, respectively, of the multiplexer 126.

Each multiplexer 124 and 126 includes two outputs, i.e., an AY and BY output, provided at pins 4 and 7, respectively. The AY output pin 4 of circuit 124 is connected to output line CT1. The BY output pin 7 of that circuit is connected to output line CT2. The AY output pin 4 of circuit 126 is connected to output line CT4 and the BY output pin 7 of that circuit is connected to output line CT8.

The selection of which input is directed to which output is effected by the signals appearing on the select input pins 14 and 2 of each circuit 124 and 126. The select input pin 14 of each multiplexer is connected to pin 12, the QC output of the nibble sequence control circuit 110, while the select input pin 2 is connected to pin 11, the QD output pin of circuit 110.

The nibble sequence control circuit 110 is a synchronous four bit counter (binary direct clear) type integrated circuit. The circuit 110 is arranged to take the master clock frequency of 14.3 MHz (as provided to its clock input pin 2) to divide that signal by 4 and 3.5, respectively, provide two clock signals on output pins 11 and 12 for control of the nibble selector.

Operation of the data latch, nibble sequence control and nibble selector is as follows: In the low resolution mode, the signal appearing on line L/H+TX causes the circuit 120 to pass its D1, C1, and B1 inputs to its QD, QC, and QB output lines LC0′, LC1′ and LC1, respectively, when the circuit is clocked at its pin 9. At the same time, the signals appearing on the 2D, 1D, 6D, 4D, 3D and 5D input lines to circuit 122 pass to the LC0, LC2, LC3, LC4, LC5 and LC6 output lines, respectively. When the address line A1 of PROM 102 is in the low state, i.e., when the upper portion of a character cell is being generated, the signals from the memory data bus lines MDR0, MDR1, MDR2 and MDR3 are passed via the data latch to the nibble selector inputs. The low control signals provided at pins 2 and 14 of the nibble selector lock the circuits 124 and 126 in a low state so that the MDR0–MDR3 signals appear at outputs CT1–CT8, respectively, of the nibble selector for the entire 3.5 color clocks. Thus, during the low resolution mode, the output signals appearing on line CT1, CT2, CT4 and CT8, constitute the signals appearing on nibble selector input lines LC0, LC0′, LC1′ and LC1, respectively. Those signals constitute the four lowest order address bits of the eight bit data code provided from the computer's memory data bus during the upper half of the character cell and the next four higher order bits during the lower half of the character.

During the high resolution mode of operation the data latch and the nibble selector operate in the following manner: The low signal appearing on line L/H+TX, directs the D0, C0, B0, and A0 lines of the multiplexer 120 to the output lines LCO′, LC1′, LC1, and S7, respectively. The 1D–6D inputs of circuit 122 are directed to output lines LC2, LC0, LC5, LC4, LC6 and LC3, respectively. Accordingly, the A0–A3 inputs of multiplexer 124 in the nibble selector is made up of signals appearing on lines LC0, LC2, LC4 and LC6, respectively. The B0–B3 inputs of multiplexer 124 is made up of signals appearing on lines LC0′, LC2, LC4 and LC6, respectively. In a similar manner with regard to circuit 126 of the nibble selector, the A0–A3 inputs is made up of signals appearing on lines LC1′, LC3, LC5 and LC7, respectively. The B0–B3 inputs of circuit 126 is made up of signals appearing on lines LC1, LC3, LC5 and LC7, respectively.

Both circuits 124 and 126 of the nibble selector 112 are cycled through their four selection states by the binary signals appearing at their input pins 14 and 2. Thus, for the first input state of the nibble selectors (i.e., the first nibble), the signals appearing on lines CT1, CT2, CT4 and CT8 constitutes the signals appearing on lines LC0, LC0′, LC1′ and LC1, respectively. In the hires mode these signals consist of the bit content of memory data bus line MDR0, MDR0, MDR1 and MDR1, respectively. The next state of the nibble selector (the next nibble) results in the signals appearing on lines LC2, LC2, LC3 and LC3, respectively, to appear at output lines CT1, CT2, CT4 and CT8, respectively. Accordingly, the second nibble provided by the nibble selector consists of a nibble whose first bit is the bit content of memory data line MDR2, whose second bit is also the bit content of MDR2, whose third bit is the bit content of MDR3 and whose fourth bit is also the content of MDR3. During the next state of operation of the nibble selector, the input lines LC4, LC4, LC5 and LC5, respectively, are connected to the output line CT1, CT2, CT4 and CT8, respectively. Accordingly, the third nibble provided by the nibble selector consists of a nibble whose first bit constitutes the bit content of MDR4, whose second bit is also the bit content of MDR4, whose third bit consists of the bit content of MDR5 and whose fifth bit is also the same bit content of MDR5. During the fourth state of operation of the nibble selector, the input lines LC6, LC6, LC7 and LC7, respectively, are connected to the output lines CT1, CT2, CT4 and CT8, respectively. Accordingly, the fourth nibble produced by the nibble selector consists of a nibble whose first bit consists of the bit content of memory data line MDR6, whose second is also the same bit content of MDR6, whose third bit consists of the bit content of MDR7 and whose fourth bit is also the same content of MDR7.

As can be seen in FIGS. 2(A) and 2(B), the four output lines CT1, CT2, CT4 and CT8 of the nibble selector are provided as inputs to the input stager circuit 46. The input stager 46 is arranged to synchronize the outputs of the nibble selector so that all of the bits making up each nibble from the nibble selector are provided simultaneously in parallel to the phase modulator, with none of the signals being skewed in time. The input stager consists of a hex, D-type flip-flops type integrated circuit. Only five input lines of that circuit are utilized herein. To that end the integrated circuit 46 includes input pin 11 (the 4D input), input pin 6 (the 3D input), input pin 13 (the 5D input), input pin 4 (the 2D input) and input pin 3 (the 1D input) connected to lines CT1, CT2, CT4, CT8 and line S7, respectively. The flip-flops of stager circuit 46 are clocked by the 14.3 MHz master clock signal which is provided to clock pin 9.

The output lines of the input stager circuit 46 are provided at pins 2, 5, 12, 7 and 10, the 1Q, 2Q, 5Q, 3Q and 4Q outputs, respectively. Thus, when clocked, the output signal appearing on pins 10, 7, 12, 5 and 2 constitutes the respective signals appearing on lines CT1, CT2, CT4, CT8 and S7. The CT1–CT8 signals are provided to the "Page" address A3–A6 inputs, respectively, of the video phase modulator ROM 48. The S7 signal is provided to the A7 input (low order of class). In that regard, the output pins 10, 7, 12, 5 and 2 of the input stager are connected to input pins 7 (the A3 input), 4 (the A4 input), 3 (the A5 input), 2 (the A6 input) and 1 (the A7 input) of the phase modulator 48. Pin 15, the A8 address line of the video phase modulator 48 is connected to the miscellaneous timing circuitry 114 line providing the HRES signal. The two low order address lines A1 and A2 of the phase modulator ROM 48 (the "Word" address lines) are provided at input pins 5 and 6, respectively.

As can be seen in FIG. 1(A), the divider circuit 50 consists of two divide-by-two stages whose input is connected to the 14.31818 MHz master clock. The divider circuit provides two outputs. One on line COB1 is an address signal of twice the color subcarrier frequency. The other output is provided on line COB2 and is an address signal of the color subcarrier frequency. The lines COB1 and COB2 are connected to "Word" address input pins 5 and 6, respectively, of the phase modulator ROM.. It is the COB1 and COB2 signals which break the color cycle into the four quadrants as described heretofore.

The ROM 48 also includes two "enable" pins 13 and 14. These input pins can be utilized to receive signals from optional means (to be described later) to select a desired palette of colors from several palettes capable of being produced by the video phase modulator 48, depending on the signals on the input pins 13 and 14. Irrespective of the palette selected, as described heretofore, the video phase modulator ROM 48 is arranged to provide any one of the five output signals on its four output lines, Q0, Q1, Q2 and Q3 (pins 12, 11, 10 and 9, respectively). Those output signals are as follows: 0000, 1000, 1100, 1110, 1111 and represent and "intensity level" of 0%, 25%, 50%, 75%, 100%, respectively, of the primary color signals present in the quadrant of the color cycle. The "intensity level" is a function of the information contained in the video phase modulator ROM's address locations.

The output stager 52 is an integrated circuit smaller to the input stager and serves the same function, that is, to straighten up all of the input signals so that they are not skewed in time when provided at its output. The output stager 52 includes 1D, 2D, 3D, 4D, 5D and 6D input lines provided by pins 3, 4, 6, 11, 13 and 14, respectively. Pins 14, 13, 11 and 6 are connected to the video phase modulator output pins 12, 11, 10 and 9, respectively. The 2D input of the output stager, that is pin 4, is connected to the video phase modulator pin 6 and to the line carrying the COB2 3.58 MHz signal (red reference). The clock input pin 9 of the output stager is connected to the 14.3818 MHz master clock signal. The 2Q–6Q output lines of the output stager are provided by pins 5, 7, 10, 12 and 15, respectively. Each output pin of the output stager is connected to a respective input of the digital-to-analog ladder network 54.

Figure 3:
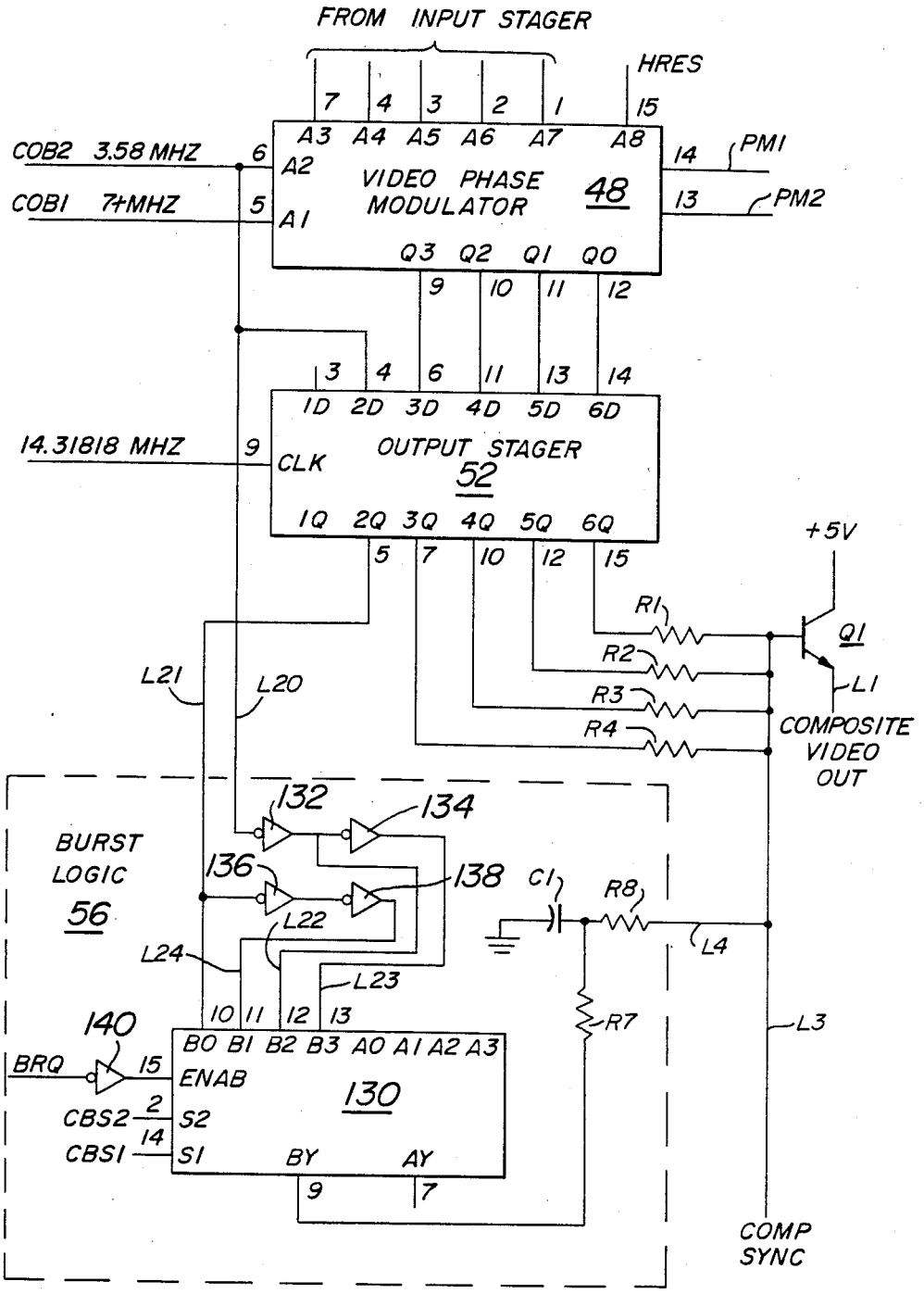
FIG. 3 is a schematic diagram of a portion of the circuitry shown in FIG. 1(B)

The digital-to-analog ladder network is arranged to convert the output signals provided from the phase modulator ROM into analog signals representative of the portion of the primary color signals present during the cycle of the color subcarrier signal. Thus, the network 54 includes four resistors R1–R4. As can be seen in FIG. 3, pin 15 of the output stager is connected to one side of the resistor R1. Pin 12 of the output stager is connected to one side of the resistor R2. Pin 10 of the output stager is connected to one side of the resistor R3 and pin 7 of the output stager is connected to one side of the resistor R4. The other side of resistors R1–R4 are connected together at the summing junction J1. The junction J1 is connected to the base of a transistor Q1 described heretofore. The transistor is connected as an emitter follower. Hence, the collector of Q1 is connected to one side of a resistor R5 (FIG. 1(B)), the other side of which is connected to a +5 volt DC bus. The emitter of the transistor Q1 is connected to composite video output line L1 and to one side of a resistor R6 (FIG. 1(B)). The other side of resistor R6 is connected to ground.

As will be appreciated by those skilled in the art, a voltage is developed across each of the resistors R1–R4 depending upon the state of the output signal appearing on lines 6Q-3Q, respectively. Inasmuch as all of the resistors are tied together at the summing junction J1, the voltage appearing at juncture J1 and hence to the base of transistor Q1 represents the sum of the analog signals being provided by each of the resistors R1–R4. This signal has the effect of changing the conduction level of transistor Q1 to provide an output signal on line L1 which is a function of the signals provided from the video phase modulator and output stager. Accordingly, the analog signal provided from the output stager to the transistor Q1 represents the portions of the red, blue and green color signals of the color subcarrier present during that respective sector or portion of the color subcarrier cycle.

The burst logic circuit 56 is coupled to the color subcarrier reference signal and is arranged to provide a conventional color burst signal during the "back porch" portion of the synchronization signals in the composite video output signal. The burst logic produces that signal in response to a burst request signal (BRQ) provided from the miscellaneous timing circuit 114 or the main logic of the computer system. The color burst signal is provided by the burst logic circuit on line L4 to the summing junction J1.

The burst logic circuit basically comprises a dual 4-to-1 data selectors/multiplexers type integrated circuit 130 and five associated inverters 132, 134, 136, 138 and 140. The circuit 130 includes, among others, one group of four input lines B0, B1, B2 and B3 at pins 10, 11, 12 and 13, respectively. The 3.58 MHz color subcarrier is provided to those four of the inputs, with the signal at each respective input being shifted in phase with respect to another input. The 3.58 MHz output signal from the circuit 130 is provided at its BY output pin 9 to a connected filter to result in the production of a reduced amplitude 3.58 MHz sine wave at the phase angle of the selected input (B0–B3) of the circuit 130.

The selection of the input for the circuit 130 is controlled by a pair of select input lines S1 and S2 provided at pins 14 and 2, respectively. These input lines are arranged for connection to optional logic circuitry (not shown) or software driven registers (not shown) located in the system to provide appropriate binary signals to select the desired input-to-output connection in circuit 130. Thus, when the circuit 130 is "enabled" and lines CBS1 and CBS2 are both low (the normal mode of operation of circuit 56) the B0 input appears at the BY output. The circuit 130 is "enabled" via its enable pin 15 connected by inverter 140 to a line from the miscellaneous timing circuit 114 carrying a burst request signal BRQ.

If a high signal is provided on line CBS1 while a low is on CBS2, the B1 input appears on the BY output. If CBS2 is high and CBS1 is low, the B2 input appears on the BY output. Finally, if CBS1 and CBS2 are both high, then the B3 input appears at the BY output.

The shifting of the phase of the 3.58 MHz color subcarrier signal is effected by the inverters 132–138. Thus, as can be seen, the input line L20 to the burst logic is connected from the line carrying the 3.58 MHz COB2 signal. Line L20 is the input to the inverter 132. The output of inverter 132 is connected to the input of inverter 134 and to a line L22 connected to the B2 input pin 12 of circuit 130. The output of inverter 134 is connected to line L23 which is connected to the B3 input pin 13 of circuit 130. The other input line L21 is connected to the inverter 136 and to the B0 input pin 10 of the circuit 130. The output of inverter 136 is connected to the input of the inverter 138. The output of inverter 138 is connected to line L24. Line L24 is connected to the B1 input pin 11 of the circuit 130.

The 3.58 MHz color subcarrier signal appearing on line COB2 is provided via pin 4 to the 2D flip-flop input of the output stager. The stager's 2Q output (pin 5) is connected to line L21, one input to the burst logic circuit 56. The other input to the burst logic circuit, namely, line L20, is directly connected to the COB2 line. Thus, the signal appearing on line L21 is the same frequency square wave on line L20 but displaced 90° in phase therewith. The square wave on line L21 is provided directly to the B0 input of circuit 130 and is the signal from which the nominal color burst signal is produced. By nominal color burst it is meant the color burst signal which will result in the production of a palette of colors which are neutrally tinted, that is, not tinted toward red or toward green. The input signals appearing on lines L24, L22 and L23, the B1, B2 and B3 inputs, respectively, of circuit 130 are shifted in phase from the signals appearing on lines L21 and L20 by virtue of their passage through the associated inverters, with the amount of phase shift being a function of the propagation delay(s) through the inverter(s). Thus, the B0 and B1 inputs are the color subcarrier shifted in the negative direction and the B2 and B3 inputs are the color subcarrier shifted in the positive direction.

As mentioned earlier, the subject invention enables one to produce multiple palettes of colors. Thus, the phase modulator ROM can be constructed with enough addressable memory locations to store the various palettes desired. Alternatively, multiple ROMs can be used. In such a case, ROMs like those described heretofore at 48 can be physically stacked on each other with their input address lines in parallel and with their output address lines in parallel. In such an arrangement, each ROM would include a respective palette of colors to be produced for the set of data codes from the memory address bus. The selection of the particular ROM to be accessed is accomplished by the enable pins 14 and 13. In this regard, ROM 48 is enabled to provide output signals when a low signal appears on both pins 14 and 13. Those pins are connected to input lines PM1 and PM2, respectively. By the use of appropriate optional logic hardware (not shown) or software driven registers (not shown) the appropriate ROM of parallel ROMs can be selected to produce the desired palette. If only a single palette is to be produced, no such optional means to provide the PM1 and PM1 signals to the desired ROM is required.

As will be appreciated from the foregoing, in effect the host system memory holds a still picture of a particular class of the display. As the eight bit data packets of the video data arrive from the host via the memory data bus, they are parallel processed by the data translator into the appropriate number of four bit (nibble) data packets. These data packets are required by the video phase modulator at the page address to fetch an output four words of amplitude modulation (as selected by the word inputs into the digital analog resistor network) and thereby reproduce the appropriate prerecorded (for the class) phase modulated output signal. By the use of the tint control of the burst logic circuit, one can shift the subcarrier reference in the receiving device to effect tint control. By stacking additional video phase modulator ROMs 48 together and controlling the selection of the appropriate ones via the PM1 and PM2 input lines provided at pins 14 and 13, respectively, one can select from various palettes of 16 colors. Moreover, the palette selection can be changed during different portions of the raster scan of the cathode ray tube or during the blanking interval.

It should be pointed out at this juncture that in some applications no data translator need be utilized. In this regard, if one were to desire to provide a system which utilized the recirculating shift register video generation technique of the aforementioned Wozniak patent, one still could utilize the teachings of the subject invention in conjunction to produce a video display having different and independently selectable colors. In this regard, the output signals from recirculating shift register could be provided to parallel processing means for use by a video phase modulator providing output signals representative of more than two intensity levels for each sequential section of one color cycle of the color subcarrier. By the use of a data translator for a host system, one can emulate the color graphic generation capabilities of various computers by appropriate design of the data translator and the video phase modulator.

As will be appreciated from the foregoing, with the prior art video generation circuitry, like that described in the Wozniak patent, by passing digital color codes through a shift register rectangular waves are generated. Such waves require a relatively wide band width to have the color repeat system to system. Moreover, such waves generate system noise, particularly at the transition points of the code going from high to low and vice versa. In contradistinction, the color generation circuitry of the instant invention for the same data code change outputs a vector sum change which is more likely to be a small change in amplitude (phase modulation) thus producing less noise.

Additional benefits of the subject invention is that it generates output for various classes of video display, e.g., high resolution, low resolution, text, without utilizing individual parallel circuits for each such class (which parallel circuits would result in an increase in system noise and power requirements.)

In accordance with the practical embodiment of the instant invention, the various integrated circuits shown herein are set forth in the following table:

| REFERENCE NO. | GENERIC NAME | MODEL |
|---|---|---|
| 48 | ROM | TBP 24S10 |
| 52 | HEX D-TYPE FLIP-FLOPS | LS 174 |
| 102 | EPROM | TMS 2532 |
| 100 | QUAD DATA SELECTOR/ MULTIPLEXERS | LS 257 |
| 120 | QUAD 2-TO-1 MULTIPLEXER WITH STORAGE | LS 399 |
| 122 | HEX D-TYPE FLIP-FLOP | LS 174 |
| 110 | SYNCHRONOUS 4 BIT COUNTER (BINARY DIRECT CLEAR) | LS 161 |
| 124 | DUAL 4 LINE TO 1 LINE DATA SELECTORS/ MULTIPLEXERS | LS 153 |
| 126 | DUAL 4 LINE TO 1 LINE DATA SELECTORS/ MULTIPLEXERS | LS 153 |
| 130 | DUAL 4 LINE TO 1 LINE DATA SELECTORS/ MULTIPLEXERS | LS 153 |

It must be pointed out at this juncture that neither the translator nor the phase modulator have to be made up of a read only type of memory (i.e., PROM, ROM, EPROM, etc.) but in fact may be formed of a dynamic or random access memory to enable color selection to be accomplished under program (software) control.

Without further elaboration, the foregoing will so fully illustrate my invention that others may, by applying current or future knowledge, readily adapt the same for use under various conditions of service.

We claim:

1. Color video generation means for use with a digital computer and a color video display, said color video display comprising a receiver having a phase demodulator operating at a color subcarrier frequency, said computer producing first digital data signals, each of which is composed of plural bits and representing a respective predetermined color out of a pallet of plural colors, said color video generation means producing one of said plural colors in a predetermined area of said display in response to receipt of a predetermined one of said first data signals, said video generation means operating on a color subcarrier signal composed of three primary color signals and comprising translator means, video phase modulator means, and output means, said translator means comprising first addressable memory means and being responsive to said first data signals for producing second, plural bit digital signals, said video phase modulator means comprising second addressable memory means and timing means, said timing means providing digital timing signals to respective first portions of plural predetermined addresses of said second addressable memory means to establish consecutive portions of one complete cycle of said color subcarrier signal, said second digital signals being provided to respective second portions of said plural predetermined addresses, said second addressable memory means having saturation data stored therein at memory locations corresponding to said plural predetermined addresses, said saturation data defining at least three predetermined different amounts of the primary color signals present in each of said consecutive portions of the cycle of the color subcarrier signal, said second addressable memory means operating in synchronism with said phase demodulator to provide respective output signals during said consecutive portions of said one complete cycle of said color subcarrier signal, each of said output signals consisting of said saturation data stored within the memory location addressed, said output signals being converted by said output means into analog signals, each of which represents the level of saturation of the three color signals making up the color subcarrier signal during each of said consecutive portions of said color subcarrier, said output signals being arranged for combination with video synchronization signals and a color burst signal to provide a composite video signal suitable for use by said phase demodulator.

2. The color video generation means of claim 1 wherein said output means comprises a resistor network for receipt of said output signals from said phase modulator means for converting said output signals into analog signals.

3. The color video generation means of claim 1 including means for changing the output signals provided by said pahse modulator means to enable the production of different colors for said first digital data signals.

4. The color video generation means of claim 3 wherein the phase relationship of said color burst signal is adjustable to vary the tint of the color produced by said display.

5. The color video generation means of claim 1 wherein the phase relationship of said color burst signal is adjustable to vary the tint of the color produced by said display.

* * * * *